US007073296B2

(12) United States Patent
Gregory et al.

(10) Patent No.: US 7,073,296 B2
(45) Date of Patent: Jul. 11, 2006

(54) PRECONSTRUCTION ANCHORING SYSTEM AND METHOD FOR BUILDINGS

(75) Inventors: Steven D. Gregory, Plano, TX (US); Christopher Wayne Bacon, Ada, OK (US); Robert Kent Pharr, Stonewall, OK (US)

(73) Assignee: Gregory Enterprises, Inc., Garland, TX (US)

( * ) Notice: Subject to any disclaimer, the term of this patent is extended or adjusted under 35 U.S.C. 154(b) by 0 days.

(21) Appl. No.: 11/064,133

(22) Filed: Feb. 23, 2005

(65) Prior Publication Data

US 2005/0141969 A1 Jun. 30, 2005

Related U.S. Application Data

(62) Division of application No. 10/369,838, filed on Feb. 20, 2003.

(51) Int. Cl.
*E02D 5/74* (2006.01)

(52) U.S. Cl. ..... 52/157; 52/155; 52/169.9; 52/292; 52/294; 52/740.1; 403/43; 403/292; 403/296

(58) Field of Classification Search ..... 52/292, 52/295, 169.9, 740.1, 159, 155–158, 167.1; 175/388, 394, 373; 403/296, 292, 307, 43; 405/230–251
See application file for complete search history.

(56) References Cited

U.S. PATENT DOCUMENTS 4,074,481 A * 2/1978 Lang et al. ..... 52/169.8
4,239,419 A * 12/1980 Gillen, Jr. ..... 405/232
4,290,245 A * 9/1981 Pardue et al. ..... 52/157
4,334,392 A * 6/1982 Dziedzic ..... 52/157
4,499,698 A * 2/1985 Hoyt et al. ..... 52/157
4,634,319 A 1/1987 May
4,673,315 A 6/1987 Shaw et al.
4,694,625 A 9/1987 Gregory
4,695,203 A 9/1987 Gregory
4,754,588 A 7/1988 Gregory
4,765,777 A 8/1988 Gregory
4,826,343 A * 5/1989 Richards ..... 403/189
4,833,846 A * 5/1989 McFeetors et al. ..... 52/154
4,878,781 A 11/1989 Gregory et al.
4,911,580 A 3/1990 Gregory et al.
5,013,191 A * 5/1991 Kitanaka ..... 405/233
5,524,405 A * 6/1996 Byrd ..... 52/295
5,722,798 A 3/1998 Gregory
5,944,452 A * 8/1999 Reinert, Sr. ..... 405/232
5,951,206 A 9/1999 Gregory
6,264,402 B1 7/2001 Vickars et al.
6,352,390 B1 * 3/2002 Jones ..... 405/230
6,352,391 B1 * 3/2002 Jones ..... 405/252.1
6,367,215 B1 4/2002 Laing
6,435,776 B1 * 8/2002 Vickars et al. ..... 405/239
6,514,012 B1 * 2/2003 Gregory et al. ..... 405/230
6,539,685 B1 * 4/2003 Bell et al. ..... 52/741.15
6,641,332 B1 11/2003 Alvarado
6,652,195 B1 11/2003 Vickars et al.

* cited by examiner

*Primary Examiner*—Peter M. Cuomo
*Assistant Examiner*—Erika Garrett
(74) *Attorney, Agent, or Firm*—Haynes and Boone, LLP

(57) ABSTRACT

A system and method of installing a preconstruction support system for a building, according to which the corresponding ends of two piling sections are connected together and an a auger is provided on one or more of the piling sections. The piling sections are driven into the ground in a manner so that a portion of the uppermost piling section extends above ground; and a concrete slab encases the portion of the piling sections.

17 Claims, 3 Drawing Sheets

10
48
12
12
12

PRECONSTRUCTION ANCHORING SYSTEM AND METHOD FOR BUILDINGS

CROSS-REFERENCED TO RELATED APPLICATION

This application is a divisional application of U.S. patent application Ser. No. 10/369,838, filed Feb. 20, 2003.

This invention relates to an anchoring system and method for supporting a building, and, in particular, to such a system which is installed prior to the construction of the building.

DETAILED DESCRIPTION

Figure 1:
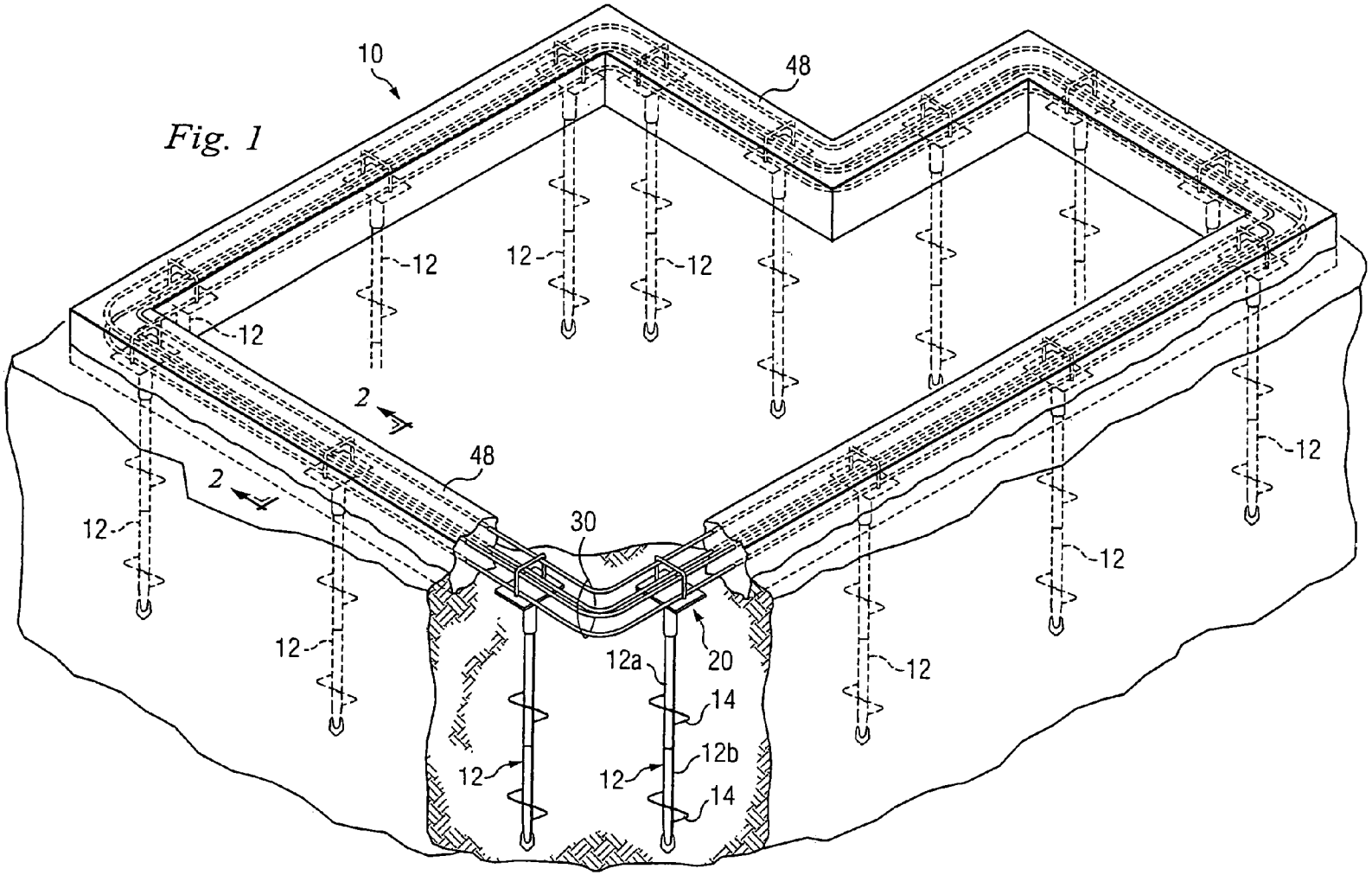
FIG. 1 is an isometric view depicting the system according to an embodiment of the present invention.
Figure 2:
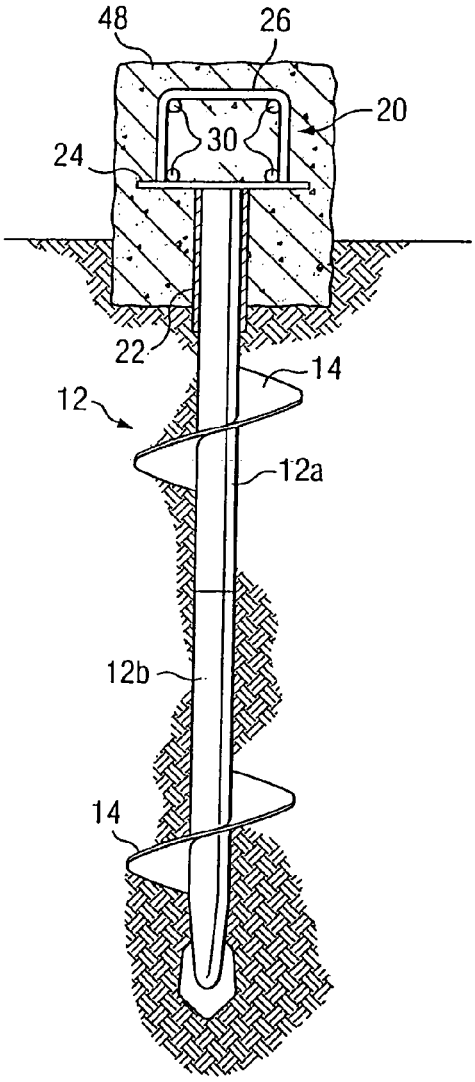
FIG. 2 is a section view taken along the line 2—2 of FIG. 1.

Referring specifically to FIGS. 1 and 2 of the drawings, the reference numeral 10 refers, in general, to a preconstruction anchoring system for buildings. The system 10 includes a plurality (in the example shown, 12) of substantially vertical anchoring elongated earth screw anchor assemblies 12 which are driven into the ground in a manner to be described. The assemblies 12 are spaced apart in a horizontal direction in a manner to form a rectangular pattern in plan view that conforms to the outer boundary walls (not shown) of the building to be constructed.

Each anchoring assembly 12 comprises two piling sections 12*a* and 12*b* that are connected together in a manner to be described, and a helical auger, or earth screw, 14 is mounted on each piling section. The piling section 12*a* is initially driven into the ground by a combination of axial and torsional forces that are applied to the members by a machine, or the like (not shown) in a manner well known in the industry. This continues until only the upper end portion of the piling section 12*a* extends above ground.

Then the lower end portion of the piling section 12*b* is connected to the upper end section of the piling section 12*b* in a manner to be described, and both sections are driven further into the ground. During this operation, the augers 14 cut into the ground and penetrate the ground in a conventional manner to facilitate the driving operation. Normally the piling sections 12*a* and 12*b* are driven into the relatively soft upper portion of the earth until a strata is encountered that is sufficient to bear the load of the building, it being understood that additional piling sections (not shown) are connected to the piling section 12*b* as needed to reach this load bearing strata.

Assuming that a load bearing strata is encountered while a portion of the piling section 12*b* remains above ground, the latter section is cut off as needed so that only a relatively small length of the latter section extends above ground as shown in FIG. 2. Then a bracket assembly 20 is mounted on the upper end portion of the section 12*b*.

The bracket assembly 20 includes sleeve 22 that extends over the upper, exposed, end portion of the piling section 20*b* and is attached thereto in a convention manner. A substantially horizontally extending plate 24 is secured, in any known manner, to the upper end of the sleeve 20, as viewed in FIG. 2. A rebar band 26, having a substantially inverted U-shape, is connected to the plate 24 by inserting the end portions of the band 26 into corresponding openings in the plate and securing the end portions to the plate in any conventional manner.

A plurality of spaced, parallel, substantially horizontally extending rebars 30 are installed, in a conventional manner on the earth's surface. As shown in FIG. 1, the rebars 30 are bent into a substantially rectangular configuration in plan view so that they extend through the band of the bracket assemblies 20 of all of the screw anchor assemblies 12 and thus generally conform to the outer boundary walls of the building.

Figure 3:
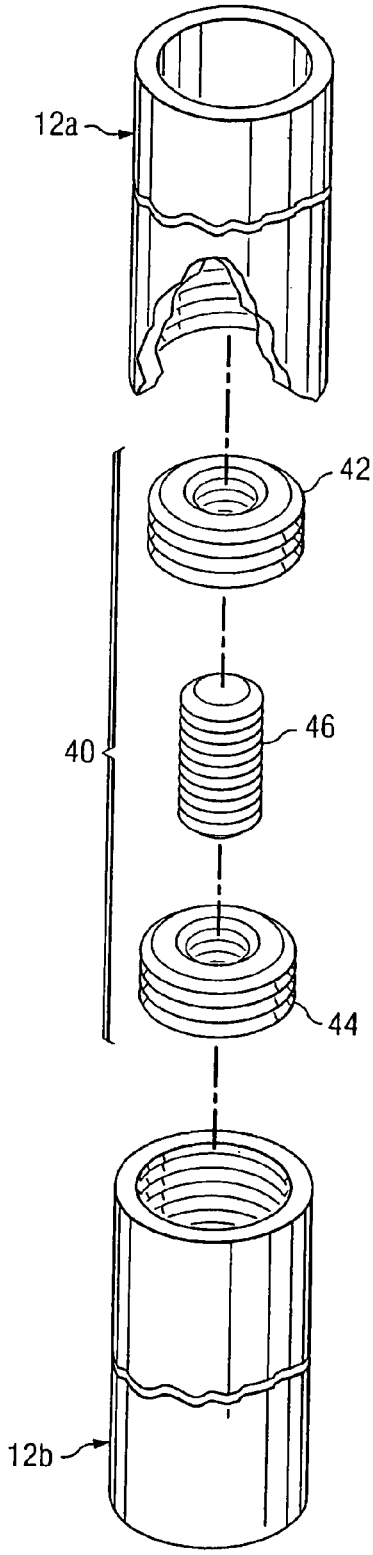
FIG. 3 is an exploded, isometric view of the apparatus for connecting the piling sections of FIGS. 1 and 2 to be connected.
Figure 4:
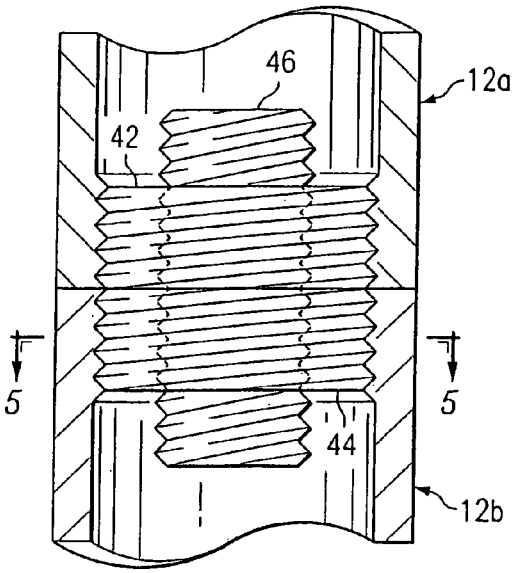
FIG. 4 is a partial, enlarged sectional view of the connecting apparatus of FIG. 3 shown in an assembled condition.
Figure 5:
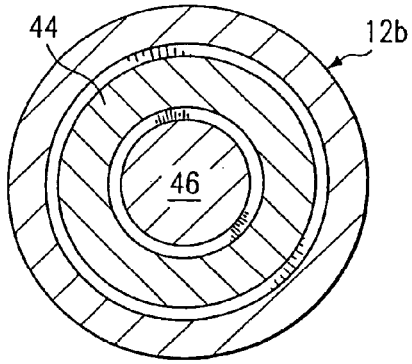
FIG. 5 is a cross-sectional view taken along the line 5—5 of FIG. 4.

An apparatus 40 for connecting the corresponding, facing ends of the piling sections 12*a* and 12*b* is shown, in general, by the reference numeral 40 in FIGS. 3–5 and includes two ring-shaped fasteners 42 and 44 each of which are both internally threaded and externally threaded. The corresponding inner surfaces of the end portions of the pilings members 12*a* and 12*b* are internally threaded so as to receive the fasteners 42 and 44, respectively in a threaded engagement. An externally threaded rod 46 is provided which is sized to threadedly engage the latter threaded surfaces of each of the fasteners 42 and 44.

To connect the piling sections 12*a* and 12*b*, the fasteners 42 and 44 are threadedly engaged in the corresponding end portions of the piling sections 12*a* and 12*b*, respectively, and thus advance into the sections until the respective faces of the fasteners at least extend flush with the respective ends of the sections. Then the respective end portions of the rod 46 are threadedly engaged in the fasteners 42 and 44. This can be done in sequence by initially inserting one end of the rod 56 in one of the fasteners 42 or 44 and rotating the rod relative to the fastener, or vice versa, to advance the rod into the fastener, and then inserting the other end of the rod in the other fastener and rotating the rod relatively to the latter fastener, or vice versa. The amount of rotation is such that each end portion of the rod 46 extends through the fasteners 42 and 44, respectively, for an axial length sufficient to permit the corresponding ends of the latter sections to abut in the assembled condition shown in FIG. 4.

In operation, the piling section 12*a* is driven into the ground in the manner described above, until the upper end portion of the piling section extends just above ground. The piling section 12*b* is then connected to the piling second 12*a* by the connecting apparatus 40, and the piling sections are further driven into the ground. This continues until a load bearing strata is reached, and, assuming that this occurs while a portion of the piling section 12*b* remains above ground, the latter portion is cut off as needed so that only a relatively small length extends above ground. The bracket assembly 20 is then secured to the upper end portion of the piling section 12*b*. Then this method is repeated for the other screw anchor assemblies 12.

The rebars 30 (FIG. 1) are then installed and routed within the clamps 26 of the screw anchor assemblies 10, as discussed above. A concrete slab 48 is then poured on the ground surface and around the rebars 30 and the bracket assemblies 20 to form a rectangular support structure for the boundary walls of the building. Additional concrete can also be poured within the support structure to complete the foundation slab for the building.

Figure 7:
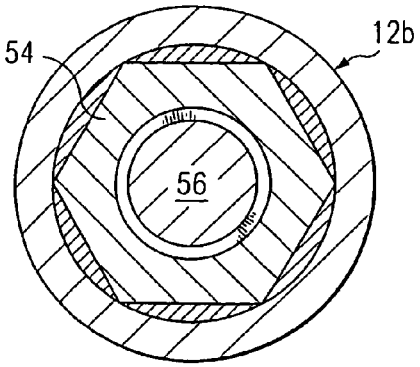
FIG. 7 is view, similar to FIG. 5, but depicting the embodiment of FIG. 6.
Figure 6:
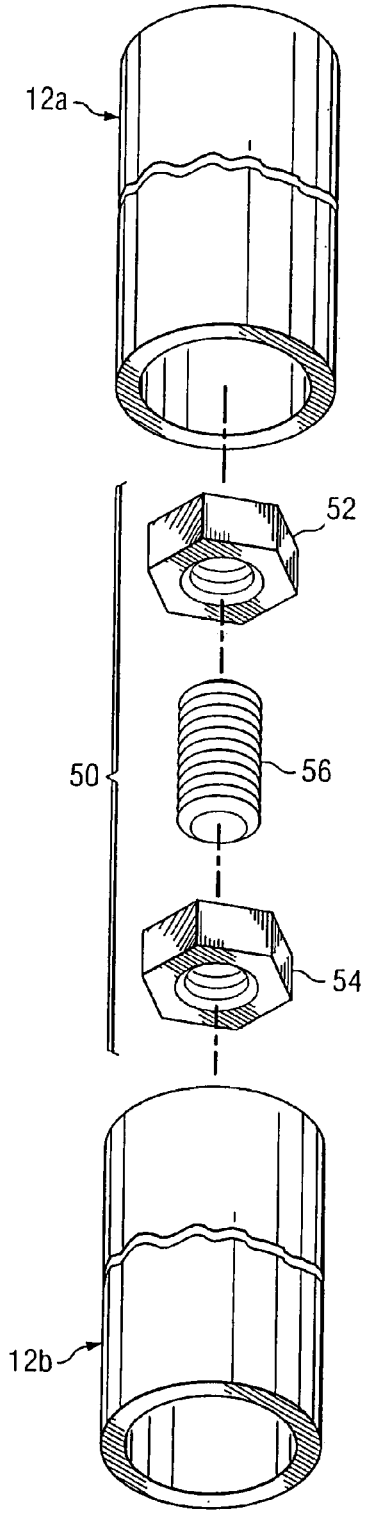
FIG. 6 is a view, similar to FIG. 3, but depicting an alternate embodiment of the connecting apparatus.

A connecting apparatus according to another embodiment is shown, in general, by the reference numeral 50 in FIGS. 6 and 7 and is also adapted to connect the corresponding ends of the piling sections 12*a* and 12*b*. The system 50 comprises two fasteners 52 and 54 which are sized to extend in the corresponding end portions of the sections 12*a* and 12*b*, respectively. The outer surface of each fastener 52 and 54 is hexagonal in shape, thus forming six planer surfaces and six angles, with the apexes of the angles between adjacent surfaces extending relative to the corresponding inner surfaces of the sections 12*a* and 12*b*, respectively, with minimal clearance as shown in FIG. 7.

The fasteners 52 and 54 are secured in the end portions of the sections 12*a* and 12*b* with the respective outer faces of the fasteners at least extending flush with the corresponding ends of the sections. This can be done in any conventional manner such as by welding the outer planer surfaces of the fasteners 52 and 54 to the corresponding inner surfaces of the sections. Each fastener 52 and 54 has an internally threaded bore, and an externally threaded rod 56, identical to the rod 46 of the previous embodiment, is provided which is sized to threadedly engage the bores of the fasteners. The sections 12*a* and 12*b* are assembled in an end-to-end abutting relationship in the same manner as discussed in the previous embodiment.

The operation utilizing the embodiment of FIGS. 6 and 7 is identical to the operation described above in connection with FIGS. 2–5 and therefore will not be described.

VARIATIONS

The number of piling sections used in each screw anchor assembly, as well as the number of piling sections that have an auger and the number of augers per piling section, can be varied.

The number of screw anchor assemblies and rebars used in the support system can be varied.

The cross section of the piling sections do not have to be circular but can take other shapes such as rectangular, square, etc, in which case the outer surfaces of the fasteners would be shaped accordingly.

The fasteners can be fastened into the interior of the piling sections by other techniques utilizing other components, such as by adhesives, bolts, pins, clips, etc.

The outer surfaces of the fasteners do not have to extend flush with the corresponding ends of the piling sections but rather can extend in the sections a predetermined distance.

One end of each rod can be directly welded into the interior of one of the piling sections and a fastener attached to the other section as described above; after which the section/fastener would be rotated relative to the rod until the corresponding ends of the piling sections abut.

The length of the rods can be varied so that, in the assembled condition of the piling section, the ends of the rods extend at least extend flush with the corresponding inner faces of the fasteners or outwardly from the latter faces a predetermined distance, including the distance shown in FIG. 4.

The screw anchor assemblies, including the piling sections, can be used in installations other than preconstruction anchoring systems described above, such as, for example, for use in raising and supporting an existing building including the foundation slab of building. For example, the present invention also lends itself to connecting pilings to raise and support buildings as disclosed in U.S. Pat. No. 5,951,206, U.S. Pat. No. 5,722,798, and U.S. Pat. No. 4,695,203, all assigned to the assignee of the present invention and all of which are hereby incorporated by reference.

Since other modifications, changes, and substitutions are intended in the foregoing disclosure, it is appropriate that the appended claims be construed broadly and in a manner consistent with the scope of the invention.

What is claimed is:

1. A preconstruction support system for a building, the system comprising:

at least one screw anchor assembly comprising:

at least two internally-threaded tubular piling sections;

connecting apparatus for connecting the piling sections, the connecting apparatus comprising:

a first externally-threaded member threadedly engaging one of of the internally threaded piling sections, a second externally-threaded member threadedly engaging the other of the internally threaded piling sections, and a connecting member engaging the first and second members to connect the piling sections in an abutting, end-to-end relationship; and at least one auger on at least one of the piling sections for cutting the earth when torsional and axial forces are applied to the piling sections to drive the piling sections into the ground in a manner so that a portion of the uppermost piling section extends above ground; and a concrete slab encasing the portion of the uppermost piling section.

2. The system of claim 1 wherein there are a plurality of screw anchor assemblies and wherein the concrete slab extends over all of the assemblies.

3. The system of claim 1 further comprising at least one horizontally extending rebar connected to each of the screw anchor assemblies, the rebar being encased by the concrete slab.

4. The system of claim 3 wherein the rebar is shaped to conform to the outer boundary walls of the building.

5. The system of claim 1 further comprising a bracket assembly connected to the upper end portion of the upper piling section, and wherein the concrete slab also extends over the bracket assembly.

6. The system of claim 5 wherein the bracket assembly comprises a sleeve extending over the portion of the uppermost piling section, a plate connected to the sleeve, and a band connected to the plate.

7. The system of claim 6 further comprising at least one rebar extending substantially horizontally and through the band and being encased by the concrete.

8. The system of claim 7 wherein the rebar is shaped to conform to the outer boundary walls of the building.

9. The system of claim 1 where the outer face of each of the first and second members extends substantially flush with the end of the corresponding piling section.

10. The system of claim 1 wherein the first and second members are also internally threaded, and wherein the connecting member is externally threaded and is in threaded engagement with the first and second members.

11. The system of claim 10 wherein the connecting member is an externally threaded rod.

12. A method of installing a preconstruction support system for a building, the method comprising:

threadedly engaging an externally-threaded member with the internal threads of a piling section;

threadedly engaging an externally-threaded member with the internal threads of another piling section;

connecting the members to connect the piling sections in an abutting, end-to-end relationship;

providing a auger on at least one of the piling sections;

applying torsional and axial forces to the piling sections to drive the piling sections into the ground in a manner so that a portion of the uppermost piling section extends above ground; and installing a concrete slab extending over the portion of the uppermost piling section.

13. The method of claim 12 wherein the step of connecting comprising providing the members with internal threads and threadedly connecting an externally threaded connector with the internal threads of the members.

14. The method of claim 12 wherein there are a plurality of screw anchor assemblies and wherein the concrete slab is installed over all of the assemblies.

15. The method of claim 12 further comprising connecting a bracket assembly to the upper end portion of the upper piling section, and wherein the concrete slab is installed over the bracket assembly.

16. The method of claim 12 further comprising installing at least one horizontal rebar over the ground and connecting the rebar to the connected piling assemblies, the rebar being encased by the concrete.

17. The method of claim 15 further comprising shaping the rebar to conform to the outer boundary walls of the building.

* * * * *